US005924857A

United States Patent [19]

Frasnetti et al.

[11] Patent Number: 5,924,857

[45] Date of Patent: Jul. 20, 1999

[54] SYSTEM FOR AUTOMATICALLY SEEKING THE MINIMUM POWER DELIVERABLE BY GAS-FIRED ATMOSPHERIC BURNERS

[75] Inventors: Luca Frasnetti, Cunardo; Giampiero Santacatterina, Sangiano, both of Italy

[73] Assignee: Whirlpool Corporation, Benton Harbor, Mich.

[21] Appl. No.: 08/697,545

[22] Filed: Aug. 27, 1996

[30] Foreign Application Priority Data

Sep. 1, 1995 [IT] Italy ..... MI95A1857

[51] Int. Cl.[6] ..... F23N 5/10

[52] U.S. Cl. ..... 431/6; 431/2; 431/18; 431/78; 126/39 BA; 126/39 E

[58] Field of Search ..... 431/2, 18, 78, 431/6; 126/39 BA, 39 E

[56] References Cited

U.S. PATENT DOCUMENTS 5,429,111 7/1995 Akamatsu ..... 126/39 BA

FOREIGN PATENT DOCUMENTS 0 124 330 4/1984 European Pat. Off. ..... F23N 1/02
0 562 538 3/1993 European Pat. Off. ..... F23N 5/20
402230013 9/1990 Japan ..... 126/39 BA

OTHER PUBLICATIONS

Japan Patent Abstract A1291017 vol. 14, No. 71 (M–0933) Feb. 1990.

European Search Report Apr. 1996.

*Primary Examiner*—Carl D. Price
*Attorney, Agent, or Firm*—Robert O. Rice; Joel M. Van Winkle; Stephen D. Krefman

[57] ABSTRACT

An atmospheric burner is associated with a flame presence sensor and an electrical-discharge ignition device. It is fed via a flow rate control device. Both the ignition device and the flow rate control device are controlled by a microcontroller. A user interface enables the user to select the desired power by sending to the microcontroller a request for altering the flow rate and hence for altering the minimum power deliverable by the burner.

17 Claims, 1 Drawing Sheet

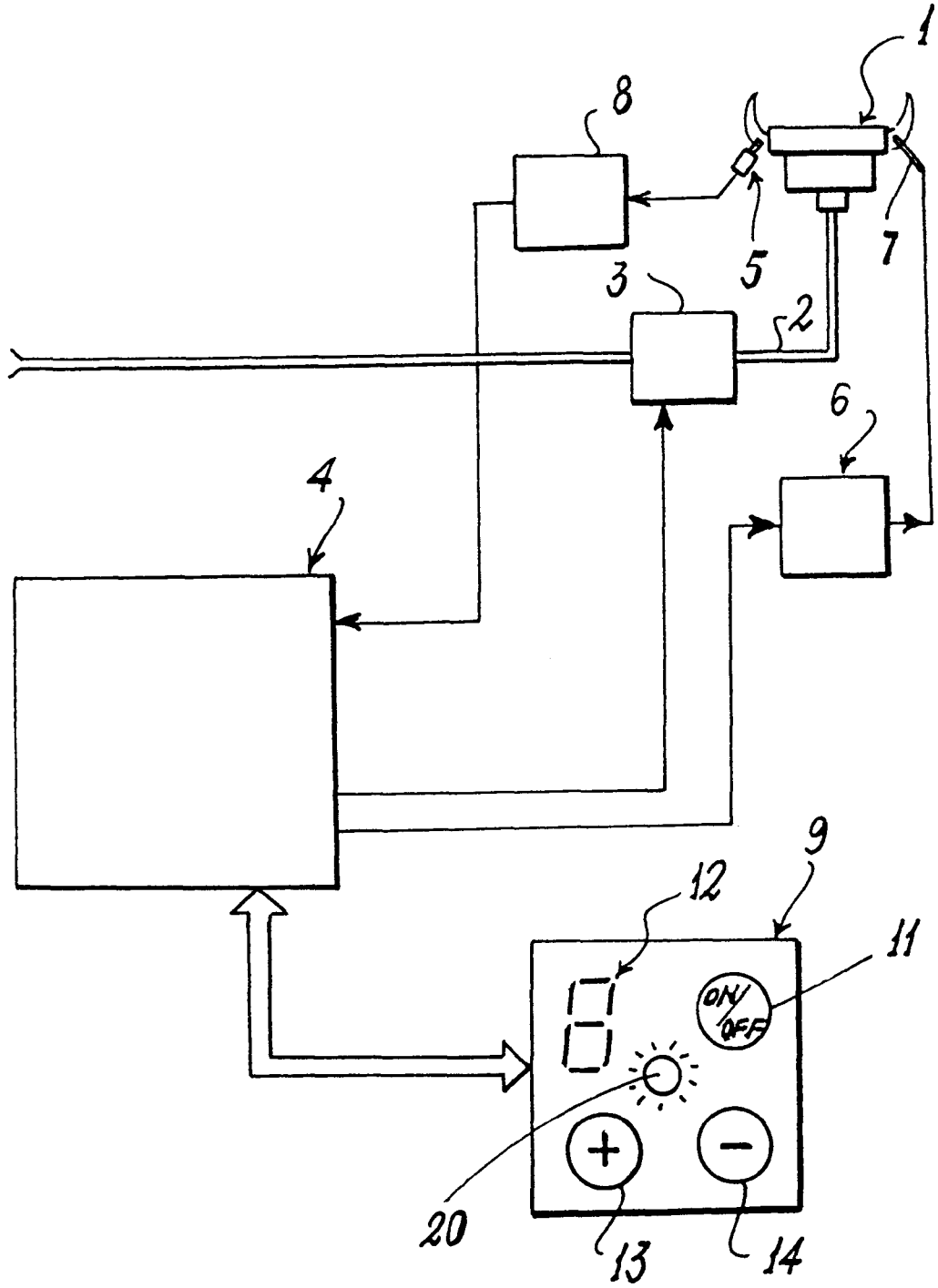
1
8
5
7
3
2
6
4
9
12
11
ON/OFF
20
13
14

SYSTEM FOR AUTOMATICALLY SEEKING THE MINIMUM POWER DELIVERABLE BY GAS-FIRED ATMOSPHERIC BURNERS

BACKGROUND OF THE INVENTION

1. Field of the Invention

This invention relates to a system for setting the minimum level of a gas-fired atmospheric burner, particularly for cooking hobs, ovens and like domestic appliances, the burner being associated with flow rate regulator means and flame detection and ignition devices.

2. Description of the Related Art

The minimum flame power deliverable by any gas-fired atmospheric burner is influenced by a large number of factors, resulting in the minimum flame power not being able to be correctly set by the final user if using known burners and the relative currently used flow rate regulator means (taps).

One of the factors most influencing regulation is clearly the gas pressure at the burner. This pressure can undergo daily fluctuation determined by the number of users simultaneously drawing gas from the mains for their appliances. It can also be influenced by the fact that the various users are connected to the mains at different points thereof, resulting in various pressure drops and pressure fluctuations.

Consequently to ensure that on rotating the tap into the minimum flame power position the flame remains alight under "any" operating conditions, a minimum power regulator screw is currently provided on the tap. This screw is used to preset at the manufacturing stage the minimum gas flow rate required to ensure that the flame is present when the gas pressure is the minimum prescribed by regulations. When the appliance provided with a burner preset in this manner is installed on the premises of the final user, the installer makes a fine adjustment using this screw. In this manner the minimum gas flow rate is ensured, but only under the operating conditions prevailing at the moment of this adjustment.

In the case of pressure change, a higher air percentage present in the pipes, surrounding draughts able to disturb the flame, dirt on the burner or any other influencing circumstance, the minimum flow rate preset in this manner can undergo change to the extent of resulting in extinguishing of the burner.

SUMMARY OF THE INVENTION

To solve the aforesaid problems the invention provides an automatic control system which seeks the minimum power deliverable by gas-fired atmospheric burners. The control system comprises a flame sensing device, a flame ignition device, a device for controlling the gas flow rate to the burner, and a device enabling the burner to be controlled by the user. These devices are connected to a microcontroller which operates the flame control device and the flame ignition device on the basis of signals which it receives from the remaining two devices, such that extinguishing of the flame leads to an increase in the gas flow rate, with the flame ignition device being operated until the flame is re-established.

BRIEF DESCRIPTION OF THE DRAWING

The invention will be more apparent from the detailed description of a preferred embodiment thereof given hereinafter with reference to the accompanying drawing, which shows schematically a control arrangement for a gas-fired atmospheric burner.

DESCRIPTION OF THE PREFERRED EMBODIMENT

In the FIGURE, the reference numeral 1 indicates a conventional gas-fired atmospheric burner connected to a gas source via a pipe 2 into which there is connected a gas flow rate control device 3, which may be a pulse-duration modulation controlled solenoid valve, a proportional valve, a motorized tap or similar means enabling the gas flow rate to be regulated non-manually. The device 3 is controlled by a microcontroller (or the like) indicated by 4. About the burner 1, such as to be grazed by the relative flame, there are provided a flame detector (such as a thermocouple) 5 and an electrical-discharge ignition device 6 the electrode of which is indicated by 7.

The thermocouple 5 is connected to an input of the microcontroller 4 via an electronic signal conditioner 8, the purpose of which is to provide said input with a digital signal indicating flame present or flame absent.

To the microcontroller 4 there is connected a user interface 9, ie a device provided with controls (of touch, knob, slider, pushbutton or similar type) on which the user acts to obtain the required flame power at the burner. The illustrated example shows in particular an ignition pushbutton 11, a display 12 showing the chosen power and two pushbuttons, one 13 for increase and one 14 for decrease, for selecting the desired power.

A certain number (for example 9) of preset flame power levels is memorized in the microcontroller 4, the lowest level being that which enables the flame to remain alight at the minimum gas pressure prescribed by regulations. This hence ensures the existence of the flame under any operating condition on initial ignition of the burner if minimum power level is selected by the pushbuttons 13, 14.

If the user wishes to obtain a power level less than that memorized (for example because the particular cooling operation requires a long time at a very low power level), the user operates the selection pushbuttons, for example by keeping the finger pressed on the power decrease pushbutton 14 after this has attained the lowest level. The microcontroller 4 then acts on the flow rate control device 3 so as to slowly reduce the power delivered by the burner 1. At the same time the microcontroller 4 continues to check the presence of the flame by reading the digital signal provided by the conditioning circuit 8 connected to the thermocouple 5.

The flow rate reduction finally reaches the point at which the flame of the burner 1 is extinguished. This occurrence is sensed by the thermocouple, and a corresponding signal reaches the microcontroller 4 to enable it to determine the final flow rate level able to maintain the flame alight. The microcontroller 4 then relights the flame by operating the electrical-discharge ignition device 6, 7 and acting on the flow rate control device 3 to obtain a flow rate which facilitates burner ignition (this flow rate value is memorized in the memory of the microcontroller 4). Having achieved relighting, the microcontroller returns the gas flow rate to the minimum level just determined, as required by the user. The burner 1 can now operate at the real minimum flow rate relative to the particular operating conditions of the moment. Simultaneously, all the operating conditions of the burner regulation system are recalibrated on the basis of the new minimum-level conditions in accordance with the new parameters contained in the microcontroller.

If these operating conditions should change such as to result in extinguishing of the flame (for example due to pressure fall, draughts in the working environment, dirt accumulating on the burner during cooking, etc.), the microcontroller 4, having been informed of the absence of flame at the burner 1, gradually increases the gas flow rate (within a preferred range but to less than a maximum value of minimum flow rate) and keeps the ignition device 6, 7 in operation, to then halt the increase in flow rate when it is informed that the flame is alight, this corresponding to a new minimum flow rate level.

If this ignition does not occur within the said flow rate range, a suitable visual indicator for example is activated, indicated by 20 and positioned on the interface 9.

In addition, the system is able to return to the preset minimum flow rate value which preceded the extinguishing of the flame. This is achieved by the microcontroller 4 sensing the signal (originating from the thermocouple 5) indicating that the flame has been relit at the new flow rate value, sensing the lack of signal from the interface 9, and comparing the flow rate value reached after re-ignition, with the preset value.

We claim:

1. A method for operating a gas fired burner, the gas fired burner having a flame sensor, a flame ignition device, a gas flow rate device for controlling the flow rate of gas to the burner, an input device enabling a user to input desired control information and a microprocessor having a memory device wherein the microprocessor has a present minimum gas flow rate to achieve a preset minimum level of power, the method comprising:

igniting the burner;

inputting control information to operate the burner at less than the preset minimum power level;

gradually reducing the gas flow rate over time below the preset minimum rate;

sensing to determine when the burner flame is extinguished and determining the minimum flow rate at which the burner flame can remain alight, the determined minimum flow rated defining a determined minimum power level;

reigniting the burner at a gas flow rate greater than the determined minimum flow rate;

reducing the gas flow rate to the determined minimum gas flow rate to operate the burner at the determined minimum power level, and if the burner flame is extinguished when operating at the determined minimum power level; and gradually increasing the gas flow rate while operating the flame ignition device until the flame is reignited.

2. The method for operating a gas fired burner according to claim 1, further comprising:

resetting the minimum power level at the flow rate corresponding to the gas flow rate at which reignition occurs.

3. The method for operating a gas fired burner according to claim 1, further comprising:

gradually increasing the gas flow rate within a predetermined gas flow range when attempting reignite the burner after the burner has been extinguished when operating a the determined minimum power level.

4. The method for operating a gas fired burner according to claim 2 further comprising:

activating a warning light when the burner fails to reignite after the gas flow rate has been increased to a maximum value within the predetermined gas flow range.

5. A control system for operation by a user for operating a gas-fired atmospheric burner, the control system comprising:

means for sensing the presence of flame at the burner;

means for igniting the burner;

means for controlling the gas flow rate to the burner;

means for allowing the user to input control selections;

means for determining and setting a minimum power level for the burner; and means for reigniting the burner if the burner flame is extinguishing while being operated at the determined minimum power level including means for increasing the gas flow rate while operating the ignition means until the flame is re-established.

6. The control system for a burner according to claim 5, further comprising:

a warning signal; and means for activating the warning signal if the burner does not reignite when the gas flow rate is increased within a predetermined range.

7. A system for automatically seeking the minimum power deliverable by a gas-fired atmospheric burner, comprising a flame presence sensing device, a flame ignition device, a device for controlling the gas flow rate to the burner, and an input device enabling the burner to be controlled by a user, comprising a microcontroller connected to the flame presence sensing device, the flame ignition device, the gas flow rate device and the input device, the microcontroller operating the gas flow rate device and the flame ignition device and determining a minimum power level on the basis of signals which the microcontroller receives from the flame presence device and the input device, and reigniting the burner upon the extinguishing of the flame which is being operated at the determined minimum power level by causing an increase in the gas flow rate, with the flame ignition device being operated until the flame is re-established.

8. system as claimed in claim 1, wherein the device controlling the gas flow rate to the burner is a flow regulator valve controlled by the microcontroller.

9. A system as claimed in claim 2, wherein the flame presence sensing device comprises a thermocouple and a conditioning device, this latter informing the microcontroller whether the flame is alight or whether the flame is extinguished.

10. A system as claimed in claim 9, wherein the flame ignition device operates by electrical discharge.

11. A system as claimed in claim 4, wherein in response to input to the microcontroller via the input device a given minimum flow rate is decreased until a lesser flow rate value at which the flame becomes extinguished is reached, this lesser value then being increased until the flame has been relit.

12. A system as claimed in claim 1, wherein the operation of reigniting the burner causes the gas flow to increase within a predetermined range while the flame ignition device is operated.

13. A system as claimed in claim 6, and further comprising a warning light which is activated if the burner does not reignite after the gas flow rate has been increased within the predetermined range.

14. A system as claimed in claim 1, wherein the flame presence sensing device comprises a thermocouple and a conditioning device, this latter informing the microcontroller whether the flame is alight or whether the flame is extinguished.

15. A system as claimed in claim 1, wherein the flame ignition device operates by electrical discharge.

16. A system as claimed in claim 1, wherein at the request of the user, formulated via the control device, a given minimum flow rate is decreased until a lesser flow rate value at which the flame becomes extinguished is reached, this lesser value then being increased until the flame has been relit.

17. A system as claimed in claim 1, wherein the extinguishing of the flame of the burner due to a change in operating conditions results in relighting of the flame at a gas flow rate level which ensures that the flame is maintained under these changed operating conditions.

* * * * *